United States Patent [19]

Hood et al.

[11] 3,948,200

[45] Apr. 6, 1976

[54] JIB SAIL SYSTEM

[75] Inventors: Frederick E. Hood; Donald K. Mitchell, both of Marblehead; Bruce H. Walton, West Hyannisport, all of Mass.

[73] Assignee: Hood Sailmakers, Inc., Marblehead, Mass.

[22] Filed: May 27, 1975

[21] Appl. No.: 580,887

[52] U.S. Cl. ..... 114/105
[51] Int. Cl.² ..... B63H 9/04
[58] Field of Search ..... 114/102–107, 114/108, 112

[56] References Cited

UNITED STATES PATENTS

| | | | |
|---|---|---|---|
| 3,658,025 | 4/1972 | Hood et al. | 114/105 |
| 3,759,210 | 9/1973 | Davis | 114/105 |
| 3,800,728 | 4/1974 | Dowling | 114/105 |
| 3,802,373 | 4/1974 | Lagerquist | 114/105 |

*Primary Examiner*—Trygve M. Blix
*Assistant Examiner*—Stuart M. Goldstein
*Attorney, Agent, or Firm*—Kenway & Jenney

[57] ABSTRACT

In the jib sail system disclosed herein, the luff edge of a jib is provided with a bead of relatively small diameter backed up by a rib of relatively large diameter. In operation, the small bead is retained in a grooved headstay member while the larger diameter rib is operated on by a guide, during the introduction of the bead into the supporting groove, but remains outside the groove after passing through the guide.

8 Claims, 4 Drawing Figures

FIG. 1
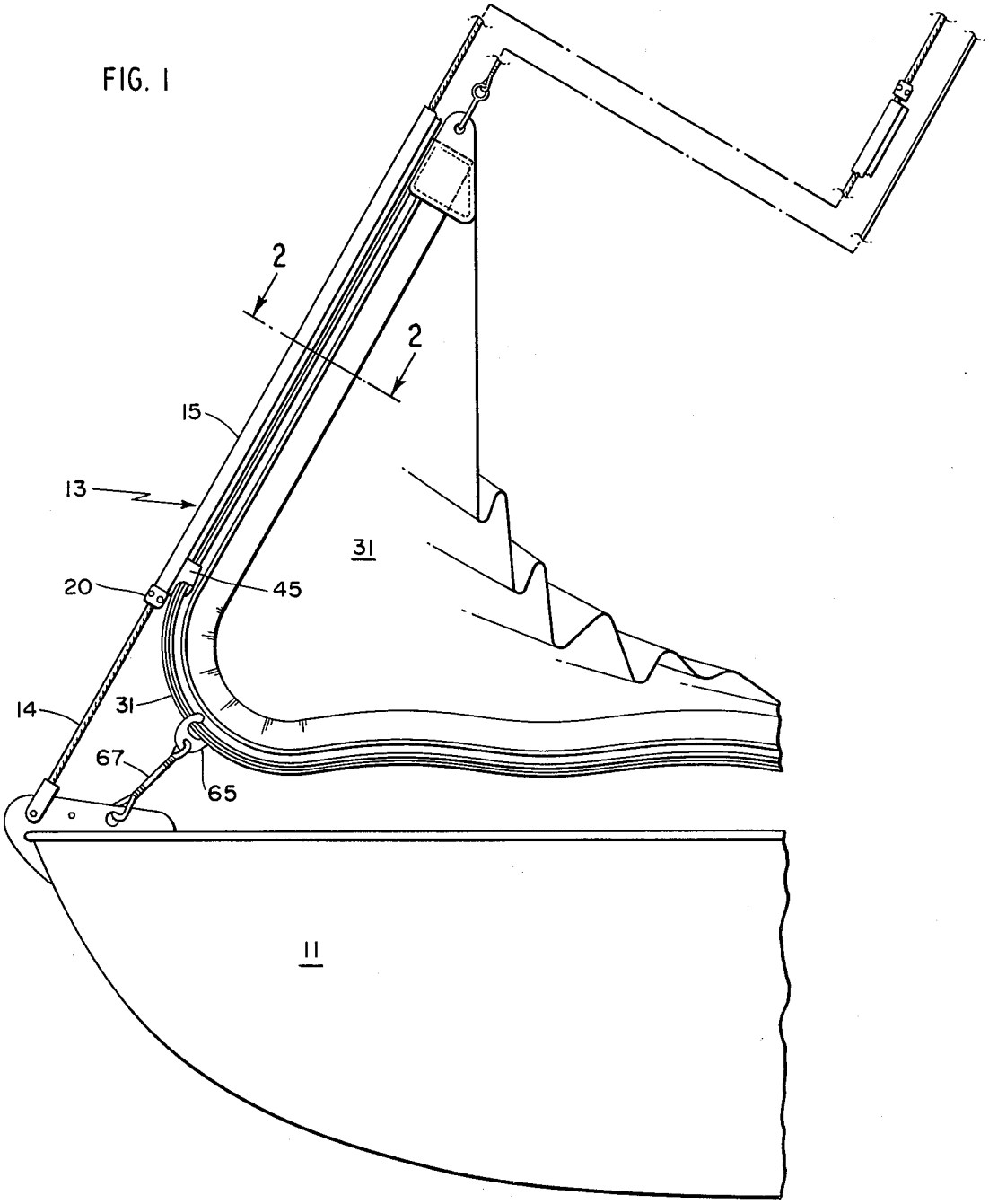
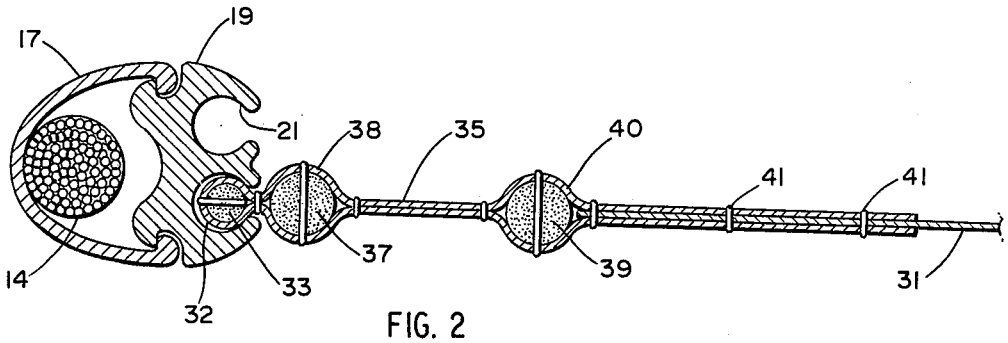
FIG. 2

JIB SAIL SYSTEM

BACKGROUND OF THE INVENTION

This invention relates to a jib sail system and more particularly to such a system employing a grooved headstay member for retaining a bead on a luff of a jib.

Various sail-support systems have been proposed heretofore in which a jib sail is raised by drawing the boltrope or other bead at the luff of the jib up through a grooved headstay member, that is, a headstay member having a C-shaped groove or keyway which will retain the bead with the body of the sail extending through the mouth of the C-shape. Such an arrangement is disclosed in U.S. Pat. No. 3,611,969. Systems for facilitating the introduction of the bead into the groove are disclosed in U.S. Pat. Nos. 3,658,025 and 3,759,210. Various cross-sectional shapes for the headstay member are disclosed in U.S. Pat. Nos. 3,851,608 and 3,851,609. Both single- and double-grooved headstay members have been proposed, a continuing object being the desire to facilitate the changing of sails, particularly during racing.

Typically, the headstay members are more or less airfoil-shaped and are mounted, usually over a separate tension member, so as to be freely rotatable and to thereby provide an aerodynamic air flow to the leading edge of the jib. In order to keep the cross-section of the headstay member or airfoil as compact as possible, it is desirable to keep the bead on the jib luff as small as possible. This is desirable when a single-groove support member is used, but is particularly important when two aft-facing grooves are employed. Heretofore, however, it has been rather universally accepted that the minimum size for the luff bead was about ¼ inch in diameter. Smaller beads were considered impossible to feed into a groove of corresponding size without repeated jamming or jumping of the bead from the groove at the point of introduction.

Among the several objects of the present invention may be noted the provision of a jib sail support system which permits jib sails to be easily changed; the provision of such a system employing a particularly compact grooved headstay member; the provision of such a system which is relatively impervious to jamming of the jib during raising; the provision of such a system which employs a jib luff bead of particularly small, nominal diameter; the provision of such a system employing a double-grooved sail-support member; the provision of such a system which is highly reliable and which is relatively a simple and inexpensive construction. Other objects and features will be in part apparent and in part pointed out hereinafter.

SUMMARY OF THE INVENTION

Briefly, a jib sail system according to the present invention employs a jib sail having at its luff edge a bead of relatively small cross-section and, closely adjacent that bead, a rib of relatively large cross-section. The bead is received in a sail-support member, such as a headstay foil, having an aft-facing groove of C-shaped cross-section. The C-shaped groove is adapted to retain the bead with the sail extending through the mouth of the C-shape.

A guide is provided at the base of the sail-support member, the guide comprising a pair of members which are spaced apart so as to form an oval aperture and then approach each other to form an aft-facing slot.

The portion of the oval aperture opposite the slot is aligned with the C-shaped groove while the balance of the oval aperture is of a size corresponding to the diameter of the rib and is shaped to guide the rib to a position just outside the mouth of the C-shaped groove with the bead passing into the C-shaped groove. Accordingly, the rib bears the forces associated with hoisting the jib, while the bead retains the sails when set.

BRIEF DESCRIPTION OF THE DRAWINGS

FIG. 1 is a side view of the bow of a sailboat showing a jib being raised in a sail-support system in accordance with the present invention;

FIG. 2 is a sectional view, taken substantially on the line 2—2 of FIG. 1 showing to an enlarged scale the cross-sectional shape of the sail-support member and the jib luff construction;

Corresponding reference characters indicate corresponding parts throughout the several views of the drawings.

DESCRIPTION OF THE PREFERRED EMBODIMENT

Figure 3:
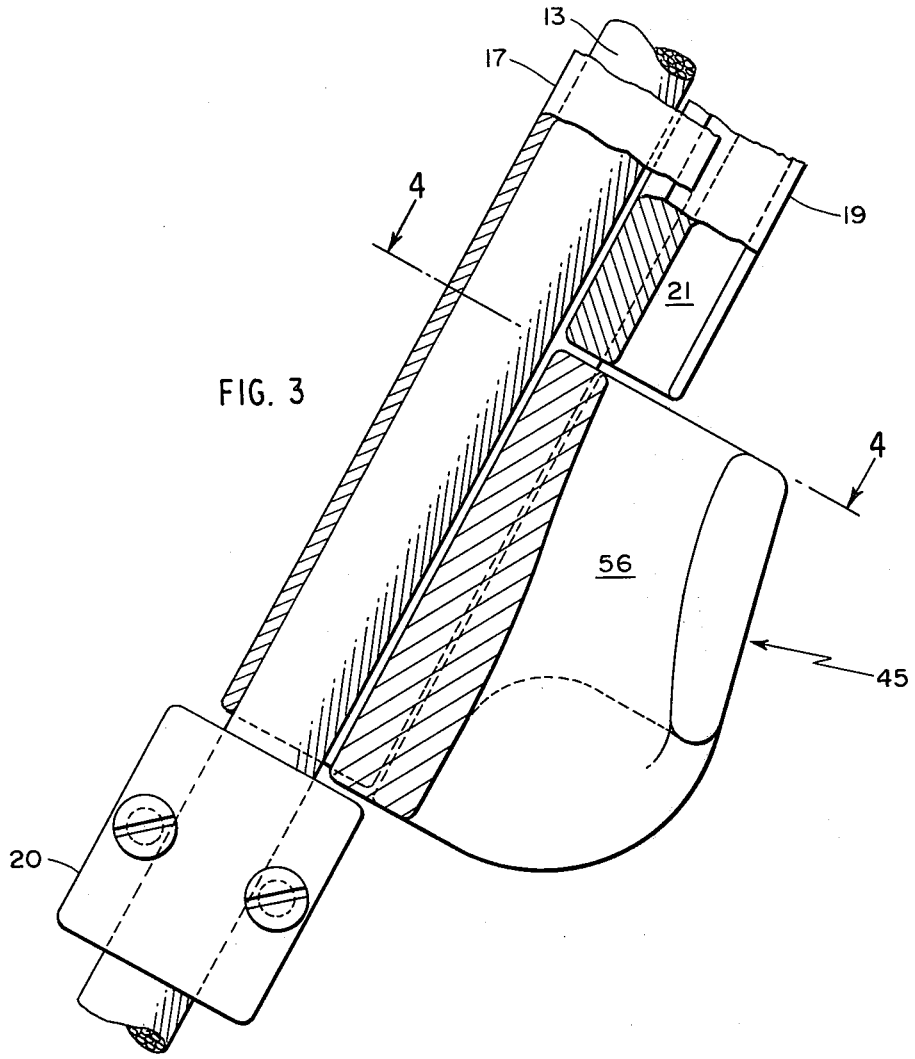
FIG. 3 is a close-up view of a guide employed in introducing the jib into the sail-support member in accordance with the present invention.

Referring now to FIG. 1, the bow portion of a sailboat is indicated at 11 generally, there being a headstay assembly 13 extending from the bow of the sailboat to the top of the mast. In addition to a wire headstay 14, which functions as a tension member, the headstay assembly includes a sail-support structure 15, which fits over the headstay 14.

As may be seen in FIG. 2, the sail-support structure 15 comprises a pair of interfitting aluminum extrusions 17 and 19 which are assembled over the wire headstay 13 so as to be freely rotatable about the wire. The sail-support structure extends over most of the length of the headstay, vertical movement being prevented by stops 20 clamped on the stay. If desired, the extrusions may be assembled from shorter segments in which case a compression spring is preferably provided under the upper stop to maintain the segments in contact. The member 17 is rounded and shaped so as to provide a generally streamlined entry for the jib. The extrusion 19 is configured so as to provide a pair of generally C-shaped grooves 21. As will be understood, these grooves will be aft-facing in actual operation of the system.

The jib, designated generally by reference character 31, is provided at its luff edge with a relatively small bead 32, the grooves 21 being sized to receive and retain this bead. As is conventional with the relatively larger beads employed heretofore, the bead 32 is provided by sewing a dense cord 33 into a folded-over tape 35 which is then sewn to the luff edge of the body of the jib 31. In accordance with the present invention, there is also sewn into the tape 35 a second cord 37 which is substantially larger than the bead cord 33. This cord is located closely adjacent and parallel to the bead cord 33 and provides, in the finished tape, a rib 38 which is closely adjacent the bead 32. For purposes explained hereinafter, a third cord 39 is also incorporated into the tape. This latter cord extends parallel to but spaced from the second cord 37 so as to provide a rib 40. The provision of this spaced rib is conventional and forms no part of the present invention. The body of the sail 31 is sewn into the tape just aft of the third cord 39, as indicated at 41. In a preferred embodiment of this tape, the bead 32 has a nominal diameter of about one-eighth inch while the ribs provided by the cords 37 and 39 have nominal diameters of about ¼ inch.

Figure 4:
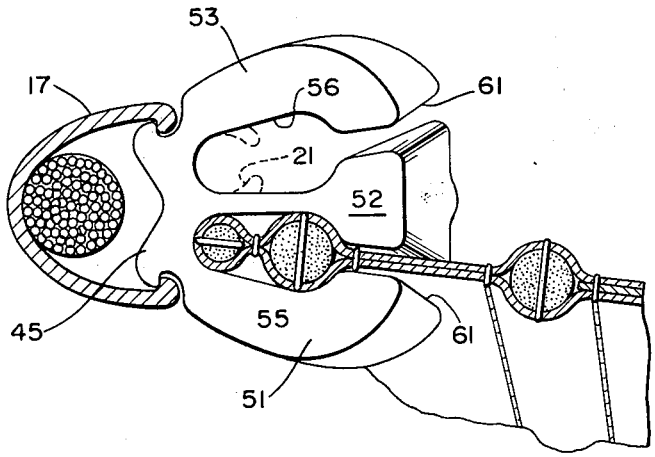
FIG. 4 is a top or end-on view of the guide.

As indicated previously, a luff bead as small as one-eighth inch was heretofore considered wholly impractical since it could not be reliably fed into a correspondingly sized, support member groove. In accordance with the present invention, introduction of the bead is reliably accomplished by utilizing a guide which operates on the adjacent rib 38 rather than on the bead so that the rib bears the forces associated with the turning of the luff into alignment with the headstay. This guide is indicated at 45 in FIG. 1 and is illustrated in greater detail in FIGS. 3–4. As may be seen in FIG. 4, the guide 45 is shaped to interfit with the extrusion 17 at the bottom of the sail-support assembly in place of the grooved extrusion 19. Extending aft are three portions 51, 52 and 53 which, between them, define two funnel-like channels or apertures 55 and 56 of generally oval cross-section. The center portion 52 is of somewhat T-shaped configuration while the outer portions 51 and 53 curve inwardly so as to form, with the center portion, a pair of aft-facing slots 61. Where the guide abuts the extrusion 19, the portions of the apertures or channels 55 and 56 opposite the slots are aligned with and in registration with the C-shaped grooves 21 and 23, respectively. This alignment is indicated in the upper portion of FIG. 4 in which the outline of the groove 21 is indicated in broken lines.

The portions of the channels 55 and 56 adjacent the slots 61 are of a size corresponding to the diameter of the rib 38 and each channel is shaped to guide such a rib to a position just outside the mouth of the corresponding C-shaped groove so that the adjacent bead 32 passes into the groove. The advantage of this system is that the rib 38, being relatively large, provides a sufficient projection for the guide to grasp and to absorb the forces required to turn and align the sail during raising but this relatively large rib does not have to go into the grooved sail-support member. The sail-support member can thus be correspondingly more compact. Further, the relatively small bead 32 does not have to resist the forces encountered during hoisting since these are borne by the rib 38.

It is understandably important that this back-up rib 38 be closely adjacent to the bead 32 and that the spacing between the bead and the rib be maintained within close tolerances corresponding to the particular groove and guide cross-sections used. This is necessary so the bead will naturally align itself with the corresponding groove 21 when the rib 38 is led to a point just outside the mouth of the C-shaped groove. In practice, the rib 38 is placed just as close to the bead 32 as is practical to permit the bead to be grasped, there being typically a single line of stitching between them. In any event, the nominal spacing between the bead 32 and the back-up rib 38 should not significantly exceed the relatively small diameter of the bead itself.

To aid the luff of the jib in its approach to the guide 45, it is preferred to use a feeder of the type disclosed in U.S. Pat. Nos. 3,658,025 and 3,759,210. In FIG. 1, this feeder is indicated at 65 and its location is determined by a flexible line or link 67 tying it to the deck of the boat 11. The feeder comprises a pair of sail-engaging elements connected by a C-shaped yoke. The purpose of the rib 40 provided by the third cord 39 is to define the sliding path of the yoke and to prevent the sail 31 from bunching up within the yoke.

In operation, it has been found that headsails can be exchanged extremely rapidly using the system of the present invention. A second sail can be raised quickly while the first jib is still set and then the first jib can be quickly withdrawn as the replacement jib is sheeted in. As the sail-support member is quite compact, the flow of air to the leading edge of a jib set in either groove is relatively smooth and thus the sail can work effectively. Even under racing conditions, the combination of the guide and the larger back-up rib has been highly effective in preventing jamming of the small bead in the grooved support member since substantially the entire force encountered during raising is borne by the larger rib, working against the guide. The height of the guide in relation to the length of the luff is selected so that the back-up rib 38 extends through the guide while the sail is set, and thus the guide also prevents tearing out of the bead from the grooved headstay member at the foot of the jib.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A jib sail system comprising:

a jib sail having at its luff edge a bead of relatively small cross-section and, closely adjacent said small bead, a rib of relatively large cross-section;

an elongate sail-support member having an aft-facing groove of C-shaped cross-section, the inside of said C-shaped groove corresponding in shape to said bead and being adapted to retain said bead with the sail extending through the mouth of the C-shape; and at the base of said sail-support member, a guide comprising a pair of members which are spaced apart so as to form an oval channel and then approach each other to form an aft-facing slot, the portion of said oval aperture opposite said slot being aligned with said C-shaped groove, the balance of said oval aperture being of a size corresponding to the diameter of said rib and being shaped to guide said rib to a position just outside the mouth of the C-shaped groove, with the bead passing into said C-shaped groove whereby said rib guides the jib sail during raising while the bead retains the sail when raised.

2. A jib sail system as set forth in claim 1 wherein the nominal diameter of said rib is approximately twice the nominal diameter of said bead.

3. A jib sail system comprising:

a jib sail having at its luff edge a bead having a nominal diameter of about one-eighth inch small and, closely adjacent said bead, a rib having a nominal diameter of about ¼ inch;

an elongate sail-support member having an aft-facing groove of C-shaped cross-section, the inside of said C-shaped groove corresponding in shape to said bead and being adapted to retain said bead with the sail extending through the mouth of the C-shape, said sail-support member being generally tubular and adapted to fit rotatably over a wire headstay;

and at the base of said sail-support member, a guide comprising a pair of members which are spaced apart so as to form an oval channel and then approach each other to form an aft-facing slot, the portion of said oval aperture opposite said slot being aligned with said C-shaped groove, the balance of said oval aperture being of a size corresponding to the diameter of said rib and being shaped to guide said rib to a position just outside the mouth of the C-shaped groove, with the bead passing into said C-shaped groove whereby said rib guides the jib sail during raising while the bead retains the sail when raised.

4. A jib sail system as set forth in claim 3 wherein said sail-support member comprises a pair of aluminum extrusions, one of which is generally arcuate, forming a rounded entry for the jib luff, and which forms a locking interfit with the other extrusion, said other extrusion providing a pair of aft-facing C-shaped grooves, each as described in claim 3.

5. A jib sail system comprising:

a pair of jib sails each having at its luff edge a bead of relatively small, generally circular crosssection and, closely adjacent said small bead, a rib of relatively large, generally circular cross-section;

an elongate sail-support member having a pair of aft-facing grooves of C-shaped cross-section, the nominal inside diameter of each C-shaped groove corresponding to the diameter of said bead and being adapted to retain said bead with the sail extending through the mouth of the C-shape; and at the base of said sail-support member, a guide comprising a central portion of generally T-shaped cross-section and a pair of side portions which are spaced from said T-shaped portion so as to form respective, generally oval, channels and which then approach the T-shaped portion to form therewith a respective aft-facing slot, the portion of each oval channel opposite the respective slot being aligned with a corresponding one of said C-shaped grooves, the balance of each oval aperture being of a size corresponding to the diameter of said rib and being shaped to guide said rib to a position just outside the mouth of the C-shaped groove with the bead passing into said C-shaped groove, whereby said rib guides a jib sail during raising while the bead retains the sail when raised and, with one of said jib sails set, the second can be raised prior to lowering the one.

6. A jib sail system comprising:

a pair of jib sails each having at its luff edge a bead of relatively small, generally circular cross-section and, closely adjacent said small bead, a rib of relatively large, generally circular cross-section, the nominal diameter of said rib being approximately double the nominal diameter of said bead;

an elongate sail-support member having a pair of aft-facing grooves of C-shaped cross-section, the nominal inside diameter of each C-shaped groove corresponding to the diameter of said bead and being adapted to retain said bead with the sail extending through the mouth of the C-shape, said sail-support member being generally tubular and adapted to fit rotatably over a wire headstay; and at the base of said sail-support member, a guide comprising a central portion of generally T-shaped crosssection and a pair of side portions which are spaced from said T-shaped portion so to form respective, generally oval, channels and which then approach the T-shaped portion to form therewith a respective aft-facing slot, the portion of each oval channel opposite the respective slot being aligned with a corresponding one of said C-shaped grooves, the balance of each oval aperture being of a size corresponding to the diameter of said rib and being shaped to guide said rib to a position just outside the mouth of the C-shaped groove with the bead passing into said C-shaped groove, whereby said rib guides a jib sail during raising while the bead retains the sail when raised and, with one of said jib sails set, the second can be raised prior to lowering the one.

7. A jib sail system as set forth in claim 6 wherein said sail-support member comprises a pair of aluminum extrusions, one of which is generally arcuate, forming a rounded entry for the jib luff, and which forms a locking interfit with the other extrusion, said other extrusion providing a pair of aft-facing C-shaped grooves, each as described in claim 6.

8. A jib sail system as set forth in claim 6 wherein the nominal diameter of said bead is about ⅛ inch and the nominal diameter of said rib is about ¼ inch.

* * * * *